United States Patent [19]

Gerard

[11] 4,187,444

[45] Feb. 5, 1980

[54] OPEN-CIRCUIT MAGNET STRUCTURE FOR CROSS-FIELD TUBES AND THE LIKE

[75] Inventor: William A. Gerard, Andover, Mass.

[73] Assignee: Varian Associates, Inc., Palo Alto, Calif.

[21] Appl. No.: 870,963

[22] Filed: Jan. 19, 1978

[51] Int. Cl.[2] ..... H01J 25/50

[52] U.S. Cl. ..... 315/39.71; 315/39.51; 315/39.75; 335/302; 335/306

[58] Field of Search ..... 315/39.71, 39.75, 39.51; 335/302, 306

[56] References Cited

U.S. PATENT DOCUMENTS

| | | | |
|---|---|---|---|
| 3,253,194 | 5/1966 | Parker | 335/302 |
| 3,454,825 | 7/1969 | Curtis | 315/39.71 |
| 3,593,239 | 7/1971 | Hofman | 335/306 |
| 3,855,498 | 12/1974 | MacMaster et al. | 315/39.71 |
| 3,984,725 | 10/1976 | Cook et al. | 315/39.71 |
| 4,048,542 | 9/1977 | Miura | 315/39.51 |

*Primary Examiner*—Saxfield Chatmon, Jr.
*Attorney, Agent, or Firm*—Stanley Z. Cole; Peter J. Sgarbossa

[57] ABSTRACT

A magnetic circuit useful in crossed field tubes and the like. At least one permanent magnet assembly is provided which includes a high flux density magnet (as Alnico), a high coercive force magnet (as Samarium Cobalt) with an end area larger than the facing end of the high flux density magnet, and polarized oppositely thereto, and an iron transition member sandwiched between the two magnets. This isolates the high coercive force magnet and concentrates its flux. When used with a second such magnet assembly to create a high magnetic flux density in a gap therebetween, for example, in the interaction space of a crossed field tube, a higher flux density is achieved in the gap than would be the case utilizing the high flux density magnet alone within the available dimensional limitations. This is particularly so in an open magnetic circuit application having only a non-magnetic flux return path.

32 Claims, 9 Drawing Figures

ALNICO ONLY
WITH 0.5" SAMARIUM COBALT
8" TOTAL ALNICO 5-7

61.8%
45.8%
4" TOTAL ALNICO 5-7

47%
31.7%
8" TOTAL ALNICO IX

86%
78%
SAMARIUM COBALT ONLY; ALNICO DEMAGNET-IZED
4" TOTAL ALNICO IX

65%
47%
FLUX DENSITY IN GAUSS
3000
2000
1000
0
CLOSED CIRCUIT
ONE RETURN
CAPS ONLY
ONE CAP ONLY
OPEN CIRCUIT

OPEN-CIRCUIT MAGNET STRUCTURE FOR CROSS-FIELD TUBES AND THE LIKE

FIELD OF THE INVENTION

This invention relates to crossed field electron tubes, such as magnetrons, for generating and utilizing microwaves, and permanent magnets and magnetic circuits useful in such tubes and other devices.

DESCRIPTION OF PRIOR ART

Generally in crossed field electron tubes, a magnetic circuit is employed including, in series, a vacuum gap in which the useful interaction field is developed, iron pole pieces on either side of the gap directed a magnetic field into the gap, permanent magnets backing each said pole piece, and a flux return path which in the past has usually been comprised of iron members forming a path connecting the outer ends of each magnet.

Recently magnetrons have appeared which have successfully dispensed with the iron flux return path. Instead, the return flux path between the outer magnet ends passes through air, vacuum, and other non-magnetic materials of the remainder of the tube structure. See U.S. Pat. No. 3,984,725, issued Oct. 5, 1976 to T. H. Schultz and A. W. Cook and assigned to the present assignee. See also Varian Tube Types VMS 1177 and VMS 1197. Such an "open circuit" design has had very marked advantages, such as elimination of the considerable weight of the iron flux return path, a much more compact design, and easier field replacement of the magnets. It does, however, entail a reduction of the useful field strength in the gap, because of an increase in the leakage flux, although providing an acceptable degree of gap flux density for many applications.

Therefore, it would be very desirable to obtain with the open circuit design a gap flux density close to that of the all-iron flux return path, or "closed circuit", designs. Attempts have been made to attain the same compactness and weight reduction goals by modifying rather than eliminating the flux path, and by utilizing permanent magnets with differing properties from Alnico, the most typical material. For example, in U.S. Pat. No. 3,843,904, issued October 1974 to W. C. Brown, the leakage field is reduced by positioning the permanent magnet inside the torodial interaction space, so that a separate flux return path outside the interaction space is not required. However, the design limits the cross section and length of magnetic material, so that Samarium Cobalt or the like is required to attain the proper magnetic performance level. Furthermore, this material can be damaged by undergoing cycling through high temperatures, so that a difficult cooling problem arises.

It also has been attempted to utilize a combination of Samarium Cobalt attached to Alnico as a substitute for the usual Alnico magnets in the aforementioned open magnetic circuit magnetrons. Again, this substitution has not had any meaningful benefit.

SUMMARY OF THE INVENTION

An object of the present invention is to provide a crossed field tube of reduced weight and greater compactness.

A particular object of the invention is to provide a crossed field tube with an improved "open" magnetic circuit design.

A more specific object is to provide a crossed field tube of "open" magnetic circuit design with a useful gap flux density comparable to that of prior closed circuit designs.

Another object of the invention is to provide a magnet structure capable of improved performance.

A more specific object is to provide an open circuit magnetic structure for a crossed field tube delivering a higher useful gap flux density than possible with prior designs.

A still more specific object is to provide an open circuit magnet structure for a crossed field tube which, within the compact and restricted dimensions available in such tubes, give a much higher useful gap flux density, superior resistance to demagnetization and comparable resistance against thermal effects as compared to prior designs.

Yet another object of the invention is to augment the performance of prior Alnico magnets.

The above objectives are met in the present invention by providing a permanent magnet assembly which includes a first magnet of high flux density, as of Alnico, and having two ends of opposite polarity, a second magnet of high coercive force greater than that of the first magnet, as for example Samarium Cobalt, and of lower flux density than the first magnet. At least one of the second magnet ends is of greater area than, and of opposite polarity to at least one of the first magnet ends. An iron transitional member is interposed between and contacting both such one magnet ends, and the surface area of the transition member in contact with the second magnet is greater than the surface area of the member in contact with the first magnet. In this way the flux density of the second magnet is concentrated to more closely match that of the first magnet. Further, the second high coercive force magnet is isolated from the first high flux density magnet, and does not influence the high flux density magnet to operate at its lower flux density, thus enhancing the efficiency of the overall assembly.

In another aspect of the invention, two such permanent magnet assemblies are utilized in a crossed field interaction device. Such device includes cathode means for generating a stream of electrons, microwave circuit means for supporting electromagnetic fields in interactive relationship with the stream of electrons, means for applying an electric field between the cathode means and the circuit means, and means for applying a magnetic field perpendicular to the electric field in the region of the stream. The means for applying the magnetic field includes a first and second permanent magnet assembly on opposing sides of the stream of electrons, the facing ends of the assemblies being of opposite magnetic polarity. Each of the magnetic assemblies comprises a sandwiched construction including a first body of magnetic material including Alnico, a second body of magnetic material including cobalt in chemical union with a rare earth element and a transition member comprising iron between the first and second magnetic bodies. The first body portion of both the magnet assemblies faces the electron stream, and the first and second bodies have respective interface surfaces facing upon the transition member. The interface surface of the second body is larger in area than the interface surface area of the first body. In this manner, a magnetic circuit is provided for the crossed field tube which provides a higher flux density in the interaction region than would be the case utilizing only the high flux density magnetic material such as Alnico. In fact, in open circuit applications wherein the outer ends of the opposed magnet assemblies do not have a magnetic flux return path, the instant magnetic circuit is comparable in performance to prior magnetic circuits with closed circuit features.

DESCRIPTION OF THE PREFERRED EMBODIMENTS

Figure 1:
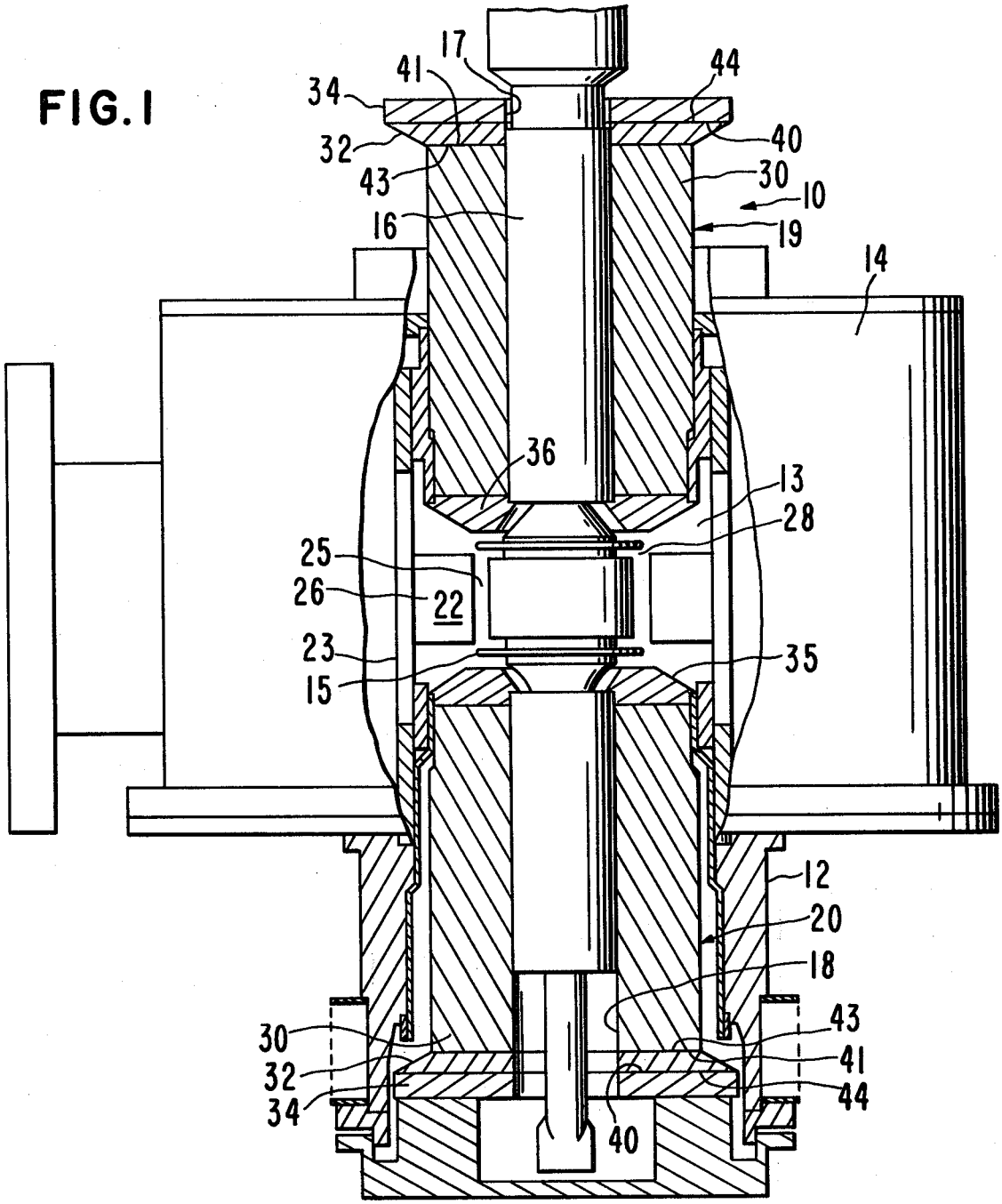
FIG. 1 is a partly schematic coaxial magnetron embodying the invention, with the axial portion thereof broken away to show the magnetic circuit of the tube in cross section.

In FIG. 1 a crossed field tube in the form of a magnetron is of conventional construction except for its magnetic circuit 10. The magnetron includes a hollow tube body structure 12 of non-magnetic material such as copper or monel defining a central cylindrical vertically elongated cavity 13 and an outer cylindrical coaxial stabilizing cavity 14. A cylindrical cathode assembly 15 is mounted in an insulating and vacuum-tight manner within tube body structure 12 utilizing vertically extending supports 16 passing through axial vertically extending apertures 17 and 18 within upper and lower permanent magnet assemblies 19 and 20.

Surrounding cathode assembly 15 is a coaxial circular array of anode vanes 22 extending inwardly from a cylindrical anode mounting 23. Vanes 22 are regularly spaced circumferentially in the customary manner to define, between adjacent vanes, cavities resonant at approximately the desired frequency of oscillation for the tube. The inner ends of the vanes 22 define the outer cylindrical boundary of a toroidal interaction space 25, while the outer surface of cathode 15 defines the inner boundary thereof.

On the outside wall of alternate vane cavities, axial slots 26 are cut through anode cylindrical mounting 23 connecting with coaxial toroidal stabilizing cavity 14. The latter may be tuned by any of several conventional mechanical expedients (not shown). Magnet assemblies 19 and 20 present opposite poles to the opposite axial ends of interaction space 25 to form an axial magnetic field therethrough across an interaction gap 28. A radially acting electric field is established between cathode 15 and the grounded anode vanes 22. Electrons drawn from cathode 15 toward vanes 22 are caused by the crossed electric and magnetic fields to travel into paths circulating around the toroidal interaction space 25, where they interact with fringing microwave electric fields of the vane cavities to generate microwave energy.

In order to maintain an efficient microwave interaction as above detailed, the magnetic field strength in the interaction space 25 must be kept at high levels. All-iron closed circuit paths between the outer ends of magnet assemblies 19 and 20 would of course preserve the highest field strength value within interaction gap 28 for a given magnetic material. However, weight considerations, the existence of modern magnetic materials, and recent designs favor open circuit, non-magnetic flux return paths as in the magnetron of FIG. 1. Here, the flux return path from the outer ends of upper magnet assembly 19 to the outer end of lower magnetic assembly 20 passes through air, the vacuum of the interaction space 25, and tube body structure 12, all of which are of course non-magnetic. Such an open circuit design previously has provided adequate field strength, but not in values approaching this closed circuit case.

Surprisingly it has been found that magnet assemblies combining a high flux density magnet (such as Alnico) with one of lesser flux density, but higher intrinsic coercive force in the manner to be described supply in the open circuit case a gap flux density very similar to that of a similarly dimensioned but all high flux density magnet in the closed circuit configuration. It has also been attempted to simply enlarge the size of a high coercive force magnet in order to obtain sufficient field strength so that it may be used alone. However, this failed with the available magnet materials such as Samarium Cobalt. It was found that in the large sizes required for the present application, a high gap flux could not be maintained; apparently, the magnet flux "short circuited" within itself.

Accordingly, the magnetron of FIG. 1 is equipped with magnet assemblies 19 and 20, each of which comprise a high flux density magnet body 30 facing interaction gap 28, a transition member 32 of a high permeability material, preferably soft iron, and a high intrinsic coercive force magnet body 34. The high flux density magnet 30 is in this case made up of Alnico 5–7 or Alnico 9, which are well known classes of alloys comprising steel, aluminum, nickel and cobalt. The high coercive force magnet 34 is in this case of Samarium Cobalt, although Samarium is not the only rare earth element which can be used with Cobalt to make such a magnet. Other rare earths alone or in combination with Samarium, and in chemical union with cobalt, may be used as well. Another example of such a combination is known commerically as mischmetal. Conventional inner pole pieces 35 and 36 of iron then complete the magnet assemblies 19 and 20. Both assemblies also include the customary axial passageway 17 and 18 as above indicated, in order to provide for cathode components, leads and mountings.

The high permeability iron transition member has been found necessary to the viability of the magnetic circuit; attempts at combining magnets of the foregoing type without such member were uniformly found to be deficient, providing no useful advantage as compared to conventional constructions made completely of Alnico. The reasons for this are not entirely clear. An analytical treatment has been attempted, but without much success; the actual delivered magnetic properties were not exactly known, and the exact operating points of the magnets, and the leakage characteristics of the circuit, could not be accurately found. Thus, the details of the invention have been worked out generally on an empirical basis. However, it is theorized that although the Alnicos are generally of higher induction, the cobalt-rare earth magnet materials have much higher energy product values, and higher intrinsic coercive forces than the Alnicos. The Samarium Cobalt materials will tend to operate at their maximum energy products, and it is at such maximum in an open circuit situation, with a permeance of one. In such an open circuit case, the Samarium Cobalt provides a flux density of 4,000 gauss (and an intrinsic force of force of 4,000 oersteds). Although Alnico 5–7 operates at a flux density of approximately 14,000 gauss in the closed circuit case, the intrinsic coercive force, and maximum energy product, is much less than that of Samarium Cobalt. Thus, it is believed that when attached directly to an Alnico, the much stronger coercive force of the Samarium Cobalt material forces the Alnico to operate near the same 4,000 gauss flux density point at which the Samarium Cobalt tends to operate. The isolation of the high flux density Alnico from the high coercive force Samarium Cobalt by the iron transition member 32 is one key element in obviating this problem.

A further important feature is needed to obtain the full benefits of the invention, and that is to properly relate the facing end areas 40 and 41 of the respective magnets so that the higher coercive force material is of larger area at its interface 40 with the iron than the interface 41 of the high induction material. Again, the reason for this requirement is not fully understood, but it is theorized that the foregoing construction causes the Samarium Cobalt to to provide a flux roughly matching that of the Alnico. The flux over the larger interface area 40 for the Samarium Cobalt is concentrated by the soft iron transition member 32. This member has two working faces 43 and 44, the first having at least the area of the Samarium Cobalt and facing thereto, and then physically terminating in a second smaller area face 44 matching the end face area 41 of the Alnico. The flux of the Samarium Cobalt is thereby concentrated to a flux density more nearly matching that of the high flux density Alnico. The latter behaves approximately as if it were a closed circuit, rather than in a conventional open circuit. Apparently, the Samarium Cobalt supplies the flux in the open circuit case which flows in the closed circuit case, thus keeping the Alnico isolated from the open return path, and keeping the Alnico operating at a higher operating point or on a higher magnetic shear line. Then in the ideal case:

$$B_1 \times A_1 = B_2 \times A_2$$

where $B_1$ is the Alnico flux density, $A_1$ is the area of the Alnico at the interface 41 with transition member 32, $B_2$ is the Samarium Cobalt flux density, and $A_2$ is the area of the Samarium Cobalt at the interface 40 with transition member 32. Then $$\frac{A_1}{A_2} = \frac{B_2}{B_1}$$

Ideally, Alnico 5–7 magnet exhibits a 14,000 gauss flux density, and the Samarium Cobalt exhibits a 4,000 gauss flux density. Substituting these values in the above, we find that $$A_2 = 3\tfrac{1}{2} A_1$$

Then for best results when using these two materials, the interface area of the Samarium Cobalt 40 should be roughly $3\frac{1}{2}$ times that of the Alnico. The larger area is needed since, as we have seen, the Samarium Cobalt tends to operate near its maximum energy product which will result in a 4,000 gauss flux density under open circuit conditions.

Figure 2:
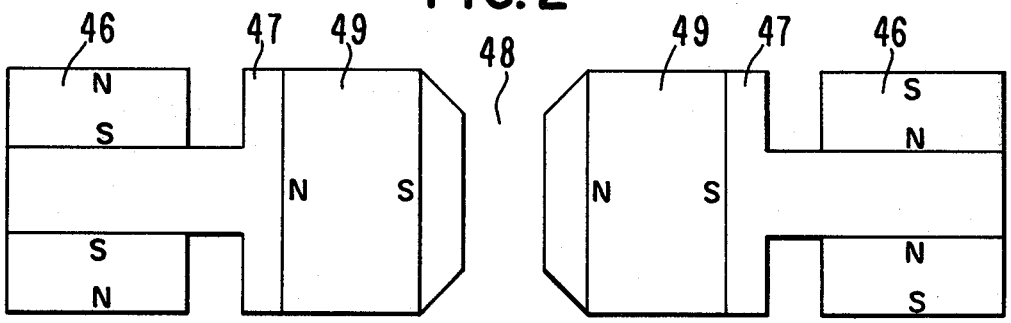
FIG. 2 is a schematic illustration of an alternate form of magnetic circuit suitable for the magnetron of FIG. 1.

These considerations apply regardless of the particular configurations of the magnetic materials and transition members. Indeed many different forms are possible; one variation is illustrated in FIG. 2. The high coercive force magnetic material is in the form of a Samarium Cobalt ring 46 magnetized in a radial fashion, as illustrated. The transition member 47 here has a T-shaped axial cross section, and provides a gap 48 between the inner side of the ring magnet and the leg of the T interfacing the Alnico magnet 49. The latter is in the usual shape seen above. This configuration again both isolates the Samarium Cobalt from the Alnico, and provides an interface area with the transition member for the Samarium Cobalt (along its south pole end) which exceeds the area of the Alnico interface with the transition member at the Alnico north pole end.

In the illustrated embodiments, the Samarium Cobalt layer, though larger in area than that of the Alnico component is not so large in area as would be the case in the ideal situation, due to the diameter and length constraints imposed by the tube environment. In one exemplary embodiment, the dimensions were as follows: the Samarium Cobalt magnet body 34 is in the form of an annular disc of approximately 4" diamter, and 0.25" thickness; the cylindrical Alnico 5–7, or Alnico 9 magnet body 30 is of approximately 3" diameter, and 4" length; the transition member 32 is 0.25" in thickness, with respective faces matching the Samarium Cobalt and Alnico bodies, and an iron pole piece 35 at the inner end of the Alnico of 0.4" thickness. Axial passageway 17, which extends through all of the assembly, is approximately 1.2" in diameter. The interaction gap 28 between upper and lower magnet assemblies 19 and 20 is 1.55" in height, the size necessary to span a typical cathode, and anode vanes 22.

The amount of gap flux density which may be obtained in an open magnetic circuit employing magnet assemblies as specified above varies with the type of intrinsic coercive force magnets, the type of high flux density magnets, their length and diameter, and the relative area of each magnet material at its interface with the iron transition. But in every case, a substantial augmentation of the gap flux density will be achieved with the present construction, as compared to a magnet assembly of similar dimensions containing only a high flux density magnetic material. In at least some cases, including the above commercially important embodiment of FIG. 1, the gap flux augmentation in the open circuit case is such that the gap flux very nearly equals that in the closed circuit case, and is a substantial fraction of that obtained with a closed circuit having only a high flux density magnetic material such as Alnico. The detailed figures illustrating this will be shown below. In all cases, a substantial improvement is obtained in open circuit performance as compared to open circuits employing only an Alnico as the magnetic material.

Figure 3A:
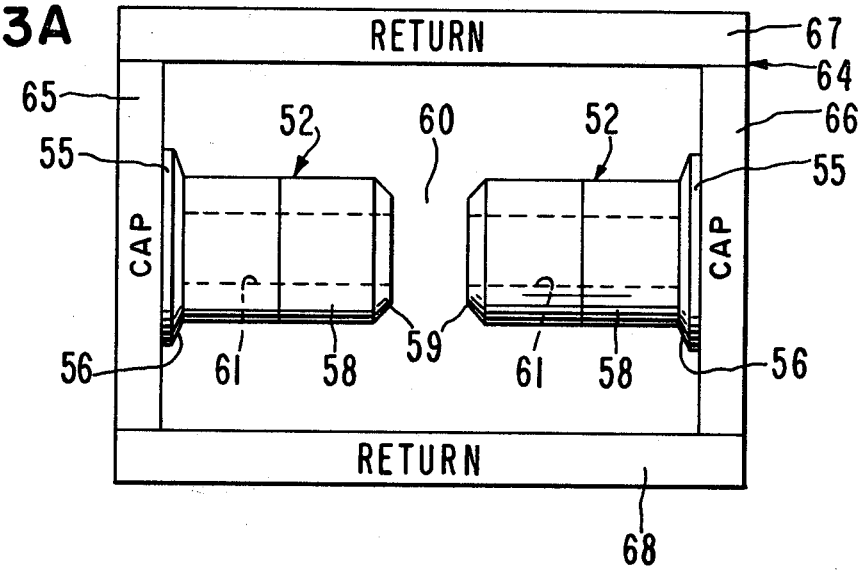
FIG. 3A shows a test assembly utilized in testing the capabilities of the magnetic circuit of FIG. 1.
Figure 3B:
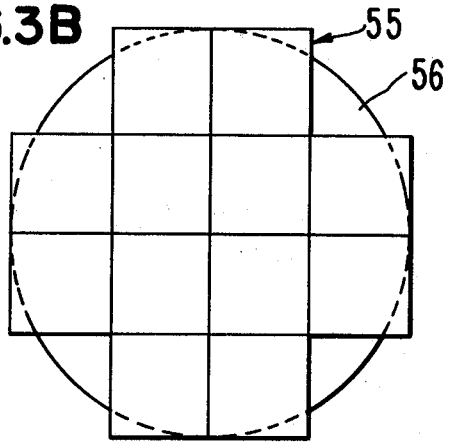
FIG. 3B shows a bottom end view of one of the magnet assemblies of the FIG. 3A test assembly.
Figure 3C:
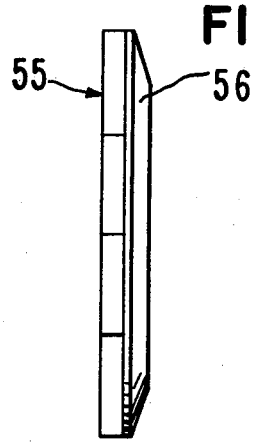
FIG. 3C shows a side view of one end of a magnet assembly of FIG. 3A opposite the interaction gap.

Some specific examples will better illustrate the substantial degree of improvement in open circuit performance which can be expected. The experimental test circuit which was utilized in designing the prototype of the FIG. 1 embodiment is useful for this purpose, since it permitted a number of variations to be examined in a configuration approximating that of the magnetic circuit of the crossed field tube. FIGS. 3A–3C illustrate this test circuit. Its magnet assemblies 52 and 53 were constructed similarly to the above-described embodiment, except that the Samarium Cobalt layer was comprised of a mosaic of twelve, 1" square by $1\frac{1}{4}$" thick squares 55 of such material, arranged over the lower surface of transition member 56, as shown in FIGS. 3B and 3C. Transition member 56 was 0.25" in thickness. The Alnico magnets 58 of each magnet assembly were either of Alnico 9 or Alnico 5–7, and either 2" long, or comprised two such units for a total of 4" in length of Alnico. The diameter of the Alnico was 3", and pole pieces 59 were 0.4" in thickness. The gap 60 between assemblies was again 1.55", and the axial passageway 61 through the magnet assemblies was 1.5" in diameter.

The heavy (8 square inch cross section) soft iron return path 64 consisted of four demountable pieces, including vertically positioned end caps 65 and 66, and horizontally positioned elongated return members 67 and 68. This scheme was used to test the capabilities of magnet assemblies constructed with two different high flux density magnetic materials, Alnico 9 and Alnico 5–7, and in two different lengths for each, i.e. 4" and 8" total magnet length for the whole assembly.

FIGS. 4A–4D illustrate these four examples graphically. In each case, two separate runs were made, one with the entire magnet assembly combination including the Samarium Cobalt, and the other with only the Alnico component, and two separate plots representing each such run were recorded, the former a solid line curve, and the latter represented by the broken line curve. In each case, the flux density in the gap 60 was measured for each of five magnetic circuit conditions; first, in a closed circuit with all portions of the soft iron flux return path 64 in place; secondly, with one of the return members 67 removed; thirdly, with both return members 67 and 68 removed, so that the "caps only" remained; then with one cap removed so that "1 cap only" remained; and finally, in a completely "open circuit" mode.

Figures 4A, 4B, 4C, 4D:
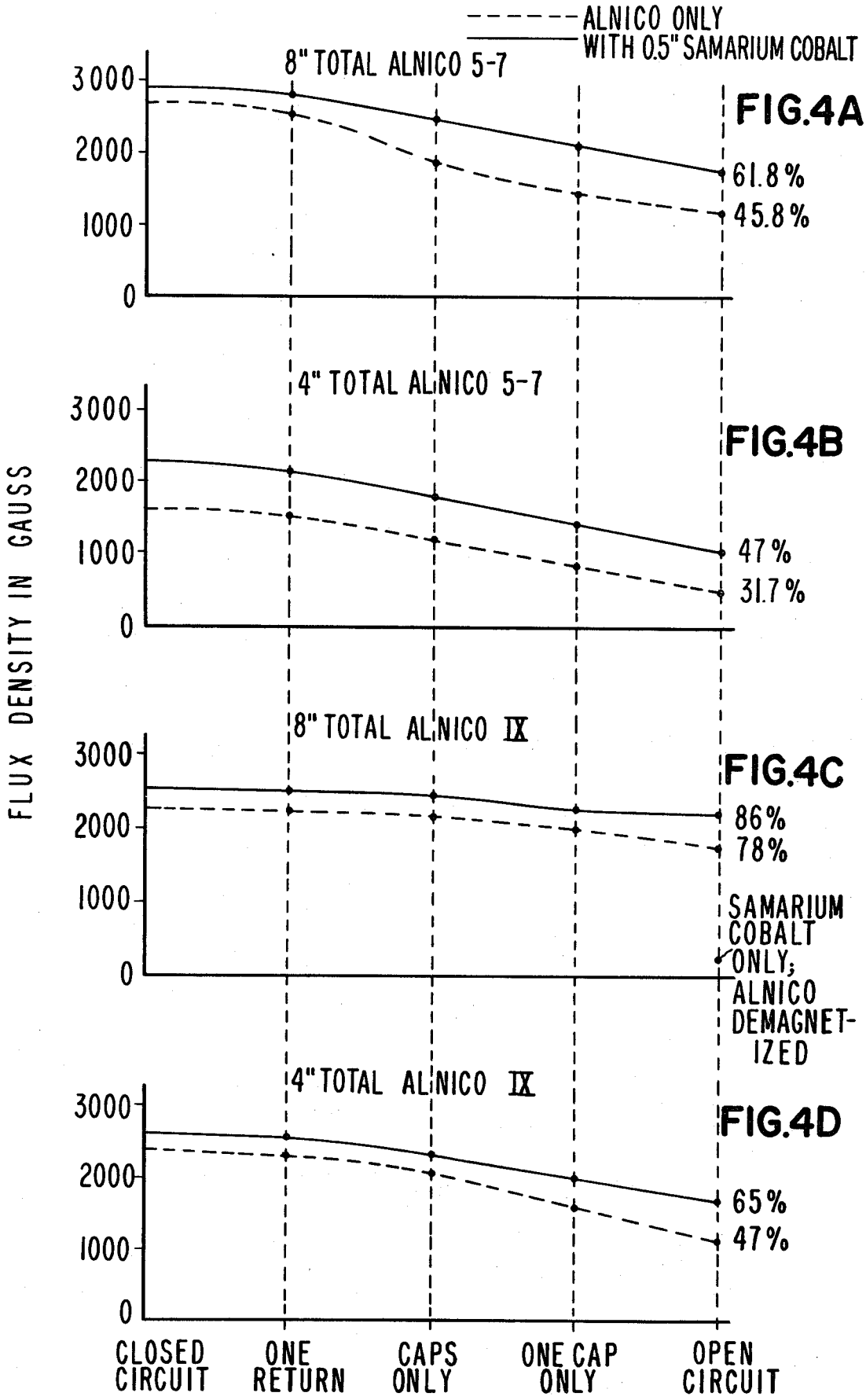
FIGS. 4A–4D show graphically the results of different configurations tested with the test assembly of FIG. 3A.

FIG. 4A plots the results in the case of a magnet circuit with 8" Alnico 5–7 (4" in each of the magnet assemblies 52 and 53). We see that as more and more portions of the heavy iron return path are removed, the gap flux density drops off until, when an open circuit is finally achieved and no portion of the iron return path remains, the Alnico by itself yields only 45.8% of its original closed circuit flux density delivered in the gap. By contrast, with the Samarium Cobalt and iron transition piece included (broken line curve), the percentage of the original closed circuit flux density delivered became 61.8%.

FIG. 4B plots the result in the case of a magnet circuit with 4" of similar Alnico 5–7 material (2" in each of the magnet assemblies 52 and 53). Here the decline of gap flux density in the open circuit case is even more pronounced; nevertheless, the new magnet assembly construction retains 47% of its closed circuit flux, while the Alnico-only magnet assembly retains only 31.7%.

FIG. 4C shows the results for a magnetic circuit with 8" total Alnico 9. Although the gap flux densities of neither the novel magnet assembly, nor the Alnico only assembly, decline as much in their open circuit condition as in the FIGS. 4A and 4B cases, again the novel construction retains substantially more of its capabilities than the Alnico-only assembly; 86% as opposed to 78%. In FIG. 4C, with smaller 4.0" Alnico 9 magnet assemblies, the same comparative performance is again observed. In the open circuit case, the Samarium Cobalt-transition member-Alnico 9 combination drops off only to 65% of its closed circuit gap flux density value, while the Alnico-only assembly drops off to 47% of its closed circuit value.

These results are unexpected evidence of the surprising benefits of the invention. Examining the FIG. 4A case of 8" of Alnico 5–7 more closely, it will be recalled that with the Alnico 5–7 alone, 45% of the closed circuit flux density was retained in an open circuit, or a value of approximately 1200 gauss. It has also been found that if only the Samarium Cobalt element were utilized, a gap flux density of 200 gauss would be established. Accordingly, it might be expected that at most, some arrangement might be devised whereby the ultimate flux density in the gap might be made to approach the sum of the above two flux values taken separately, or 1400 gauss. In fact, however, we have seen that the complete instant combination yielded in the open circuit case 61.8% of the closed circuit value, or a gap flux density of 1750 gauss. This is a gain of 350 gauss over the maximum 1400 gauss value which might have been expected. Apparently, the operating point of the Alnico is enhanced, or it is made to operate on a higher shear line than would be the case without the instant inventive combination.

Even further improvements in the performance of the open magnetic circuit compared to the closed version of the same circuit have been obtained. For the latest product design, exemplified in FIG. 1. Table A below summarizes the results of this product design in line A. For comparison line B shows the results which are obtained with a similar but all-Alnico magnetic circuit:

TABLE A

| Magnet | Length | Closed Circuit Flux | Open Circuit | Wt. | Cost |
|---|---|---|---|---|---|
| (A) Alnico IX + Iron Adapter + $SmCo_5$ | 9" | 2850 | 2600 | 14 | $ 600 |
| (B) Alnico IX | 9" | 3500 | 2270 | 22 | $1,000 |

In both cases the high flux density material was Alnico 9, and the total length of the assembly, including Alnico 9, iron transition member, and Samarium Cobalt, was 9". For the product design of line A, closed circuit gap flux density would have been 2850 gauss, and the actual open circuit embodiment delivered 2600 gauss gap flux density, or 91.3% of its closed circuit value. This percentage could be made even higher were it not for the present dimensional restrictions, particularly the 4" diameter figure, imposed by tube design considerations. Thus, dimensional restrictions do not allow quite enough Samarium Cobalt area to obtain the ideal relationship between the transition member interface area 40 of the high coercive force Samarium Cobalt, and the interface area 41 of the high flux density Alnico 9.

Comparing to line B representing the similar all Alnico 9 magnetic circuit of 9" length, it was found that in the closed circuit case 3500 gauss gap flux was delivered, to 2270 gauss in the open circuit case. Thus, a much smaller percentage of the closed circuit capability was retained in the open circuit case than with the present design. Furthermore, although less Alnico 9 was utilized in the inventions product design, 330 gauss more flux density was obtained in the open circuit case than with the Alnico 9 only example of line B.

Besides the very substantial improvement in open circuit performance, and in augmentation of the gap flux density capability of the Alnico, the present invention provides dramatic improvement in weight reduction and costs. The closed circuit iron return path is even more readily dispensed with, since the open circuit capabilities are now much greater with the present invention. As may be seen from Table A, the all Alnico circuit involves a weight of approximately 22 lbs., while the design of the present invention weighs only 14 lbs. Cost savings are equally dramatic, from roughly $1,000 for the all-Alnico example down to $600 for the novel configuration. Although in some embodiments, benefits were obtained even when like poles of the two magnetic materials both faced the transition member in a "bucking" fashion, the best results, and the results which are set forth above, were obtained when opposite magnetic poles of the two magnets formed the interfaces with he transition member, so that the two magnets were in "aiding" relationship.

The invention may clearly be applied to other tubes, including all varieties of crossed field microwave electronic tubes such as linearly disposed amplifiers and circularly disposed amplifiers having either reentrant or non-reentrant beams. Indeed, it may be utilized in any application requiring a high and uniform gap field strength, particularly where space is restricted, and the high resistance to thermal disturbances of Alnico is desired.

What is claimed is:

1. In an open permanent circuit defining a relatively small working gap a permanent magnet assembly comprising:

a first body comprising magnetic material including Alnico and having north and south pole faces, said body defining one boundary of said working gap with one of said pole faces;

a second body comprising magnetic material including Cobalt in chemical union with a rare earth element and having north and south pole faces;

and a transition member comprising iron, said member being interposed between said first and second bodies in contact with opposite pole faces of said bodies such that said first body contacts said transition member with the other of said pole faces, and said second body contacts said transition member with a pole face thereof which is polarized oppositely to said other pole face of said first body, whereby the flux density within said working gap is enhanced.

2. A magnetic assembly as in claim 1, in which said first body face has an area $A_1$ and said second body face has an area $A_2$ and area $A_2$ is greater than $A_1$, whereby the flux of said second body is concentrated and tends to match that of said first body.

3. An assembly as in claim 2 in which area $A_1$ is to area $A_2$ as the intrinsic force of said Cobalt magnetic body is to the intrinsic force of said Alnico magnetic body.

4. An assembly as in claim 2 in which said first body has a length $L_1$ and said second body has a length $L_2$, and the length $L_1$ is greater than $L_2$.

5. An assembly as in claim 1 in which the volume of said first body is greater than the volume of said second body.

6. An assembly as in claim 1 in which said first and second magnetic body and said transition member are aligned along a central axis, and in which said faces are parallel to and concentrically aligned along said axis with one another, and in which said transition member includes two oppositely facing outer surfaces, each surface being generally congruent with the body face which it contacts.

7. An assembly as in claim 6, in which said first and second magnetic bodies are cylindrical, and said transition member is in the form of a truncated cone.

8. An assembly as in claim 6, in which said transition member includes a radially extending first portion adjacent to said first body, a second portion axially extending away from said first body, said second body interfacing with said transition member along said axially extending second portion.

9. An assembly as in claim 8, in which said second body is spaced from said first portion of said transition member, and the areas that interface of said second body and said transition member exceeds the area of the interface between said transition portion and said first body.

10. An assembly as in claim 1, in which said rare earth is samarium.

11. An assembly as in claim 1, in which said Alnico is Alnico 5–7.

12. An assembly as in claim 1, in which said Alnico is Alnico 9.

13. An open permanent magnetic circuit for developing an optimal degree of flux density within a gap in said circuit, comprising:

a first permanent magnet assembly;

a second permanent magnet assembly spaced from said first magnet assembly and in alignment therewith so as to form a first gap therebetween, with the north pole of one assembly facing the south pole of the other across the gap;

each of said magnet assemblies comprising a sandwich construction including a first body of magnetic material including Alnico, a second body of magnetic material including Cobalt in chemical union with a rare earth element and a transition member comprising iron between said first and second bodies, the first body portion of both said magnetic assemblies facing said gap, said first and second bodies having respective interface surfaces facing upon said transition member, said second body interface being larger in area than said first body interface area, whereby magnetic flux density within said gap is optimized.

14. A circuit as in claim 13, in which the volume of said first bodies is larger than the volume of said second bodies.

15. A circuit as in claim 13, in which the area of said second body interface is related to the area of said first body interface as in the flux density of said first body is related to the flux density of said second body.

16. A circuit as in claim 13, in which a non-magnetic return path is provided for the magnetic flux flowing between the outer most ends of said first and second magnetic assemblies.

17. A circuit as in claim 13, in which said rare earth is samarium.

18. In a crossed-field interaction device including cathode means for generating a stream of electrons, microwave circuit means for supporting electromagnetic fields in interaction relationship with said stream of electrons, means for applying electric field between said cathode means and said circuit means, and means for applying a magnetic field perpendicular to said electron field in the region of said stream, the improvement wherein said means for applying a magnetic field comprises:

a first and a second permanent magnet assembly on opposing sides of said stream of electrons, the facing ends of said assemblies being of opposite magnetic polarity;

each of said magnet assemblies comprising a sandwich construction including a first body of magnetic material including Alnico;

a second body of magnetic material including cobalt in chemical union with a rare earth element, and a transition member comprising iron between said first and second bodies, the first body portion of both said magnet assemblies facing said electron stream, said first and second bodies having respective interface surfaces facing upon said transition member, said second-body interface surface being larger in area than said first-body interface area.

19. The device as in claim 18 in which the return flux path between the outer ends of said first and second magnet assemblies is substantially through non-magnetic media.

20. A device as in claim 19 in which said permanent magnet assemblies are elongated, and said first bodies are of substantially greater length and volume than said second bodies.

21. A device as in claim 19 in which said transition member is of substantially less length and volume than said first bodies.

22. A device as in claim 18 in which said first and second bodies are of cylindrical configuration, and said transition member is in the form of a truncated cone.

23. In an open magnetic circuit a permanent magnet assembly comprising:

a first magnet of high flux density material, said magnet having two ends of opposite magnetic polarity;

a second magnet of high coercive force material, said coercive force being greater than that of said first magnet, said high coercive force material having lower flux density than said first magnet, said second magnet having two ends of opposite magnetic polarity, at least one of said second magnet ends being of greater area than, and of opposite polarity to, at least one of said first magnet ends;

and an iron transitional member interposed between and contacting both said one second magnet end, and said one first magnet end, the surface area of said member in contact with said second magnet being greater than the surface area of said member in contact with said first magnet end, whereby the flux density immediately adjacent said other, free end of said first magnet is enhanced as compared to comparably-sized magnet assemblies of either of said materials alone.

24. An assembly as in claim 23 in which the surface portions of said iron transitional member facing said one magnet ends are coextensive therewith.

25. An assembly as in claim 23 in which said first magnet is of substantially greater volume than said second magnet.

26. An assembly as in claim 25 in which said second magnet of high coercive force is of cobalt in chemical union with a rare earth element.

27. An assembly as in claim 25 in which said first magnet of high flux density is one of Alnico 5–7 material.

28. An assembly as in claim 25 in which said first magnet of high flux density is of Alnico 9 material.

29. A permanent magnet assembly as in claim 23, in which said assembly is aligned along a straight central axis, whereby said enhanced flux density is developed at said other free end in the axial direction.

30. An open permanent magnetic circuit defining a relatively small working gap and a relatively large non-working gap, and developing an optimal degree of flux density within said working gap, comprising:

a first permanent magnet assembly;

a second permanent magnet assembly spaced from said first magnet to define said working gap therebetween, with the north pole of one assembly oriented toward the south pole of the other assembly;

each of said assemblies comprising a first magnet of high flux density, a second magnet of high coercive force greater than that of said first magnet and of lower flux density than said first magnet, and a transition member comprising iron between and contacting both said magnets;

the high flux density first magnet portions of both said assemblies being in opposed relationship across said working gap;

said first and second magnets having respective interface surfaces facing upon said transition member, said second magnet-transition member interface being larger in area than said first magnet-transition member interface, whereby magnetic flux density in said working gap is optimized.

31. A circuit as in claim 30, in which the area of said second magnet-transition member interface is related to the area of said first body interface as the flux density of said first body is related to the flux density of said second body.

32. A permanent magnet assembly as in claim 1, in which said first body comprises a magnet element of said magnetic material, and an iron pole piece element having two faces, with one face in contact with said magnet element, and the other face thereof defining said one boundary of said working gap.

* * * * *